US005609556A

United States Patent [19]

Rostalski et al.

[11] Patent Number: 5,609,556

[45] Date of Patent: Mar. 11, 1997

[54] METHOD AND APPARATUS FOR MANUFACTURING BAGS WITH STRAP-SHAPED CARRYING HANDLES

[75] Inventors: Fred Rostalski, Bielefeld; Diethard Obermeier, Bad Salzuflen; Ewald Steinweg, Borgholzhausen; Wilfried Kolbe, Gülzow; Klaus Schirrich, Bielefeld, all of Germany

[73] Assignee: Fischer & Krecke GmbH & Co., Bielefeld, Germany

[21] Appl. No.: 328,288

[22] Filed: Oct. 21, 1994

[30] Foreign Application Priority Data

May 27, 1994 [DE] Germany ..... 44 18 470
Sep. 6, 1994 [DE] Germany ..... 94 14 380 U

[51] Int. Cl.[6] ..... B31B 29/86; B31B 31/86

[52] U.S. Cl. ..... 493/226; 493/926

[58] Field of Search ..... 493/210, 221, 493/226, 264, 267, 334, 909, 926, 936

[56] References Cited

U.S. PATENT DOCUMENTS

| | | | |
|---|---|---|---|
| 2,197,827 | 4/1940 | Novick . | |
| 2,346,710 | 4/1944 | Steen | 493/226 |
| 2,529,976 | 11/1950 | Stranberg | 493/221 |
| 2,985,355 | 5/1961 | Read | 493/221 |
| 3,101,033 | 8/1963 | Bonsor | 493/221 |
| 3,392,636 | 7/1968 | Lindley . | |
| 3,439,591 | 4/1969 | Class | 493/221 |
| 3,507,194 | 4/1970 | Schwarzkopf . | |
| 3,613,523 | 10/1971 | Wesselmann | 493/221 |
| 3,722,377 | 3/1973 | Hayes | 493/221 |
| 3,753,824 | 8/1973 | Bosse | 493/926 |
| 3,835,756 | 9/1974 | Bosee . | |
| 3,850,724 | 11/1974 | Lehmacher . | |
| 3,857,329 | 12/1974 | Lehmacher et al. . | |
| 3,865,018 | 2/1975 | Gaffney . | |
| 4,018,142 | 4/1977 | Canno | 93/35 H |
| 4,148,431 | 4/1979 | Lepisto . | |
| 4,362,526 | 12/1982 | Wilson | 493/226 |
| 4,854,931 | 8/1989 | Roberts et al. | 493/348 |
| 5,062,717 | 11/1991 | Shockley | 383/20 |
| 5,298,007 | 3/1994 | Achelpohl et al. | 493/226 |
| 5,356,221 | 10/1994 | Achelpohl | 493/226 |
| 5,378,220 | 1/1995 | Bunn | 493/226 |
| 5,382,215 | 1/1995 | Mattiebe | 493/926 |
| 5,421,805 | 6/1995 | Baxter | 493/226 |

FOREIGN PATENT DOCUMENTS

| | | |
|---|---|---|
| 1152602 | 8/1963 | Germany . |
| 1611657 | 1/1971 | Germany . |

*Primary Examiner*—Jack W. Lavinder
*Assistant Examiner*—Christopher W. Day
*Attorney, Agent, or Firm*—Richard M. Goldberg

[57] ABSTRACT

A method for manufacturing bags (18) with strap shaped handles (16) which provides for the handles to be bonded to the outside faces of the bags by attachment portions (24) at the free ends of their parallel legs, in which assembling and bonding of the handles (16) is effected during continuous transport of the bags (18), with their bottoms (20) forward, from a bag making machine (10) in which the bags without handles are produced, to a stacker station; the handles are folded such that their portions (26) protruding beyond the bag marginal edge while in the usage position are folded over forwardly as viewed in bag transport direction; and the handle portions (26) as folded over are detachably tacked to the bags (18) and/or the attachment portions (24) before the bags are entering the stacker station (14).

6 Claims, 4 Drawing Sheets

METHOD AND APPARATUS FOR MANUFACTURING BAGS WITH STRAP-SHAPED CARRYING HANDLES

BACKGROUND OF THE INVENTION

The present invention relates to a method and apparatus for manufacturing bags with strap shaped carrying handles.

Bags made of paper, foil material or the like are largely being used for packaging purposes or, if provided with handles, as shopping bags.

Prior known in the art are bag making machines of the type in which bags are in a first continuous process manufactured without handles by cutting blanks to any predetermined size from paper webs as well as by folding and bonding said blanks. The last station in such bag making machines is usually a bottom folding drum in which the bag bottoms are formed. The bags leave the bag machine in a dead flat position and with their bottoms forward.

It is a freqently adopted practice to pass the bags to a stacker station immediately after completion thereof in which they are collected into stacks and if so required into larger size packs.

Strap shaped handles may be bonded to the bags as carrying aids and specifically in the case of environmentally acceptable paper bags mostly consist of multilayered paper strips folded into a U, shaped configuration. By the end portions of their parallel legs, hereinafter referred to as attachment portions— these strips are bonded to the bags such that U-shaped handle portions, hereinafter referred to as handles, will protrude beyond the marginal edge of the bags.

Handle bonding is generally done in a separate step using a handle assembling device. For this purpose, bags are taken from the stack, individually passed through the handle assembling unit and then immediately filled or again collected into stacks.

Since this way of proceeding is relatively complicated and expensive it would be desirable to bond the handles to the bags immediately on completion of said latter and before the bags are allowed to enter the stacker. This goal is however difficult to achieve because the projecting handles tend to aggravate bag handling inside the stacker station so that such bags provided with handles cannot be processed in conventional stacker stations.

Manufacturing processes are known from practice which provide for the handles to be bonded to those sides of the paper webs inside the bag making machine already which subsequently become the inside faces of the bags. In such cases, the handles may either protrude from the bags or the projecting handles can be turned inward such that they get entrapped between the wall members of the bag and thus are kept from hampering any of the subsequent processing steps. This way of proceeding however calls for use of a bag making machine of specific design.

SUMMARY OF THE INVENTION

The object of the present invention is to provide a method for manufacturing bags with handles which can be carried into effect by just slightly modifying existing plants for producing and stacking bags not fitted with handles and which is adoptable for and compatible with plants in a variety of designs.

The method according to the present invention provides for the handles to be bonded to the outside faces of the bags during their continuous transport from the bottom folding station of the bag machine to the stacker station. The term "bonding" as used throughout the following description and the patent claims will be understood to generally comprise any and all suitable bonding techniques inclusive of hot-sealing and in the case of foil bags also welding.

Handle bonding is done such that the handles are backfolded outwardly against the bags and/or against the handle attachment areas such that there is no obstruction inside the stacker station. Since the bags are leaving the bottom folding station with their bottoms forward and therefore the handles need to be bonded to the trailing end of the bags, the handles as folded over are extending forward against the bag conveying direction. To keep the handles from folding open again in the course of subsequent handling inside the stacker station, they are temporarily fixed to the bag or to the handle attachment areas by tacking. While in this state and condition, the bags can be handled in conventional stacker stations initially designed for bags not provided with handles.

This implies that the method of the present invention is not requiring any special design of the stacker station nor of the bag making machine itself.

The tack of the backfolded handles preferably should remain also during bag packaging, storage and transport and will not be detached until a user wants to use the bag as a carrying or shopping bag.

While tacking of the backfolded handles preferably will be accomplished by using a low-strength adhesive dot such that the handles can be easily detached and folded to usage position later on, it is also possible to adopt other tacking techniques such as crimping, punched and backfolded lugs and the like.

The method according to the present invention, in addition to being based on the solution principle hereinbefore described, also provides for handles to be bonded to a tubular starting stock before the individual bags are produced from said tubing. Handle foldover in this case for instance offers the advantage that after the handles have been bonded in place the tubing can be cut directly adjacent the backfolded handles to thereby divide it into a plurality of sections used for forming the individual bag units. The bags may thereafter be fed to the bag making machine in immediate succession without need to previously increase the spacing between successive bag units. When a bottom of a bag is folded and sealed inside the bag machine, the handles of the preceding bag in each case are not interfering. This implies that the method is adoptable in such plants also where starting stock and finished bags are transported at equal speed so that the spacings between individual bags cannot be varied by accelerating or decelerating the bags.

As the finished bags are leaving the bag machine and discharged to a conveyor belt for instance, the successive bags are yet spaced from each other because the bag length is shorter after completion of the bottom than the length of the blanks prior to bottom sealing. This is the reason why handling of the finished bags in the downstream stacker station is no problem.

BRIEF DESCRIPTION OF THE DRAWING

Preferred exemplified embodiments of this invention will now be described in greater detail with reference to the drawing in which.

DESCRIPTION OF THE PREFERRED EMBODIMENTS

Figure 1:
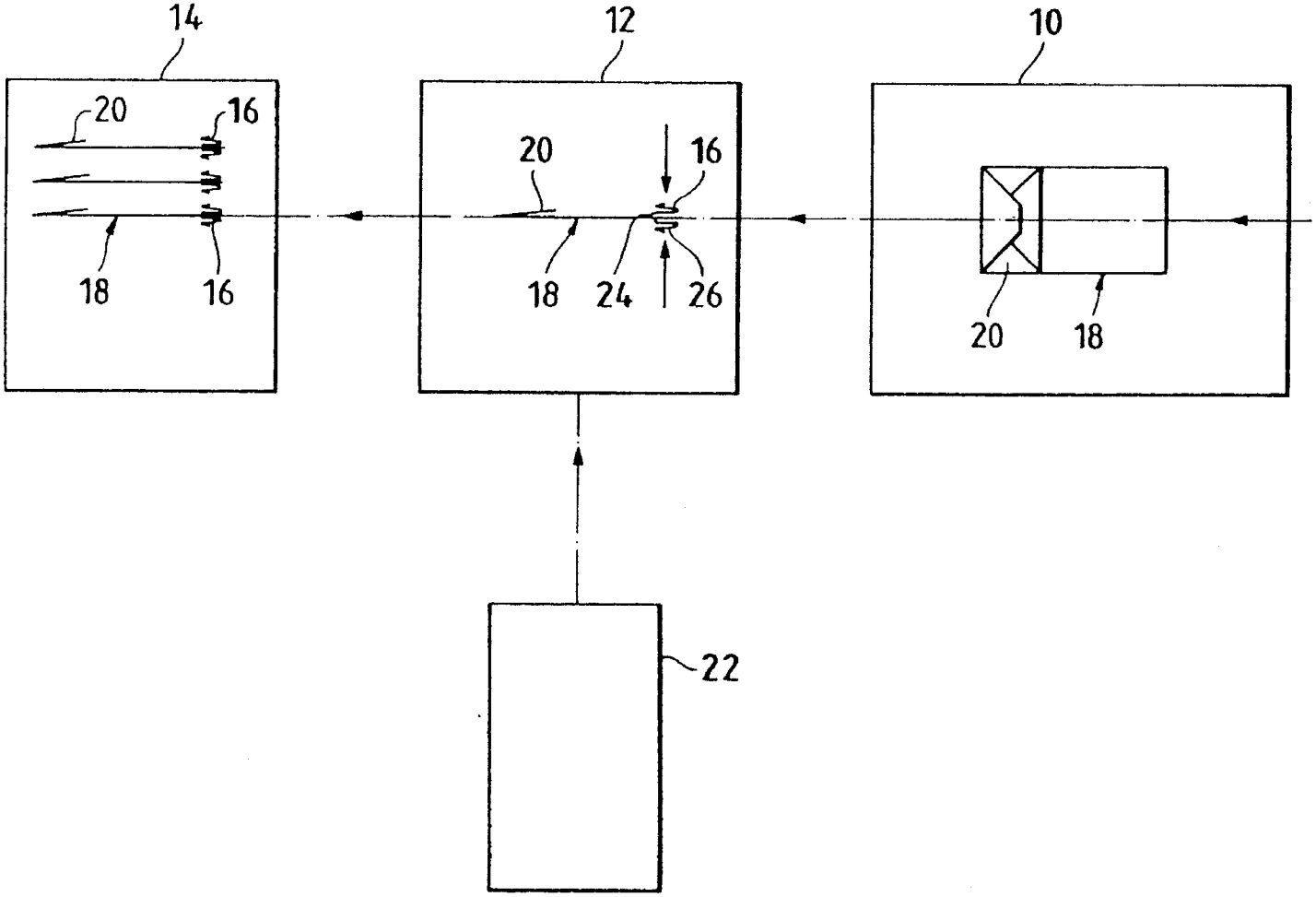
FIG. 1 is a diagram basically illustrating the working principle to a first embodiment of the method.

FIG. 1 shows a production line comprising a bag making machine 10 of conventional design, a handle assembling unit 12 whose design will be described in greater detail hereinafter, and a stacker station 14 of conventional design in which the bags 18 provided with handles 16 are collected into stacks and if so required also into larger size packs. A block representing the bag machine 10 shows a bag 18 which is drawn in top view representation in the very state and condition in which it leaves the bag machine. The folded and bonded bottom 20 of said bag flatly contacts the wall members of the bag and as viewed in transport direction (from right to left in FIG. 1) constitutes the leading end of the bag.

Conventional belt conveyors are used to pass the bag on to the handle assembling device 12. The block representing that unit shows a bag 18 schematically drawn in side elevation. Disposed at the side of the handle assembling unit 12 is a handle strip payoff device 22 adapted to feed two endless handle strips, i.e. the starting stock for forming the handles, to said handle assembling unit 12 cross to the flow direction of the bags 18. These handle strips are provided in the form of multilayered paper strips which are either reeled into rolls in multilayered condition already or will be folded to such multilayered configuration as they are being pulled off the roll. The design of such handle strip payoff devices is generally known in the art and therefore will not be described in closer detail hereafter.

The two handle strips as fed are each cut to a predetermined length inside this handle assembling unit 12 and each formed into a rectangularly U-shaped handle 16 by two 45° folds which handles are then bonded to the trailing (open) end of the bag 18 from top and bottom the way as represented by arrows in FIG. 1. At this stage, each handle 16 is additionally folded once in cross direction to make it directly contact the bag 18 by its attachment portions 24 formed by the free ends of its parallel legs while its U-shaped portion 26 is backfolded to said attachment portions 24 against bag flow direction so that it will not protrude beyond the bag marginal edge. The attachment portions 24 will be bonded to the respective wall member of the bag 18 and the backfolded handles 26 will be detachably fixed to said attachment portions 24 so that the state and condition in which the bag 18 fitted with handles is leaving the handle attachment unit 12 will be retained in the stacker station 14 also.

The design and arrangement of the handle assembling device 12 shall now be explained with reference to FIG. 2.

Figure 2:
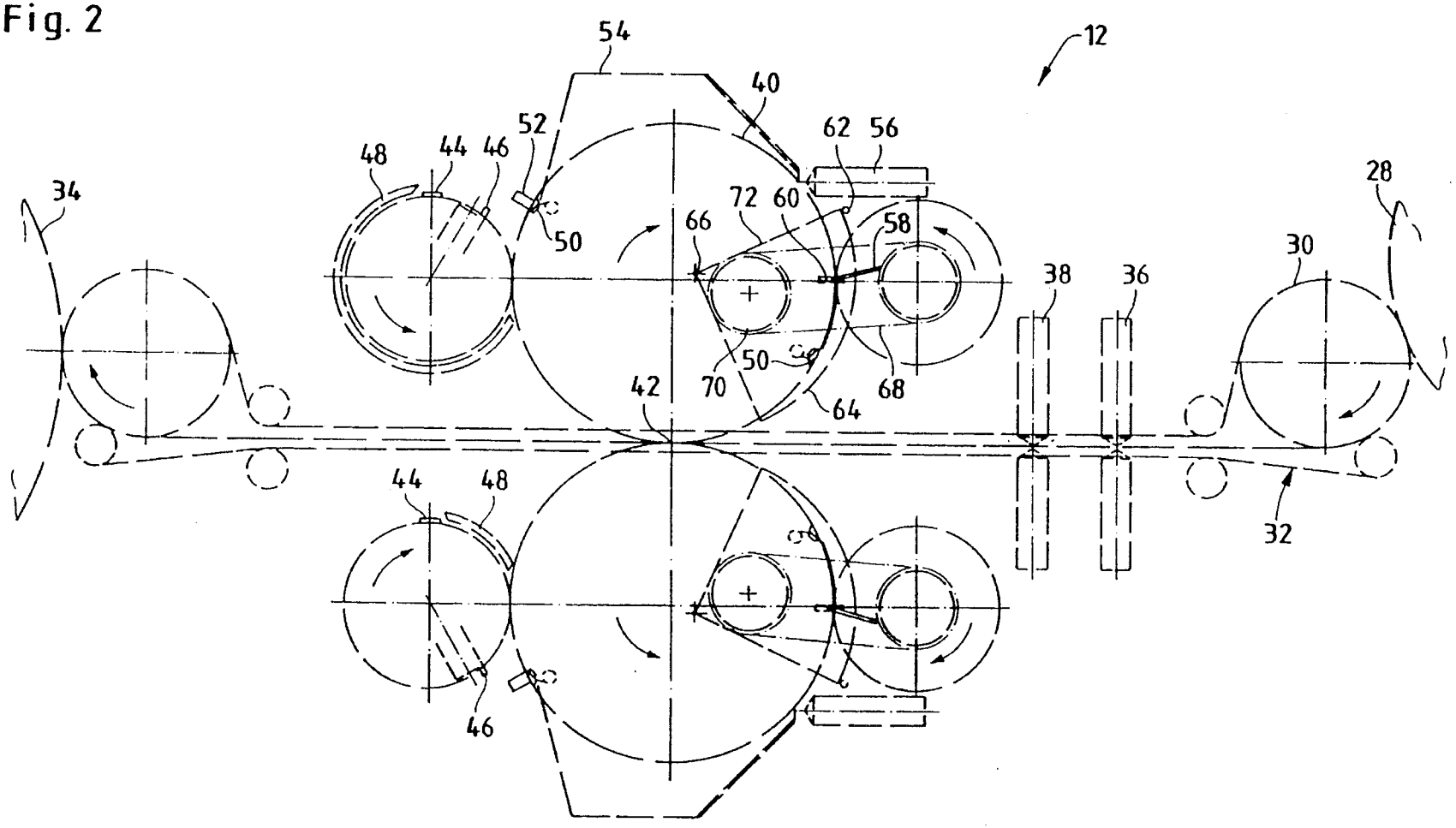
FIG. 2 is a schematic longitudinal section through a handle attachment unit.

Outlined on the right side in FIG. 2 is part of the peripheral edge of a bottom folding drum 28 being part of the bag making machine 10. It is from this bottom folding drum 28 that the individual bags are being picked up with the aid of a gripper drum 30 and by means of a belt conveyor 32 continuously being carried through the handle assembling unit 12. The bags are transferred to a drum 34 of the stacker station 314 from the discharge end (on the left side in FIG. 2) of said belt conveyor 32.

The components hereafter described of the handle assembling unit 12 are arranged in symmetrical relation to the bag transport line as defined by the belt conveyor 32 so that the component parts disposed above the transport route level only will be described.

Two adhesive applicator stations 36, 38 are provided in the area upstream the handle assembling unit to apply two different types of adhesive to those bag regions to which the attachment portions 24 of the handles are to be bonded. One of these applicator stations is used to apply a quick-curing hot adhesive to thereby ensure that the handles 16 as bonded will adequately keep in place in the course of subsequent processing operations inside the stacker station 14. A long run higher adhesive strength is obtained by additional application of cold glue. A handle assembling drum 40 is provided to attach the handles 16 to the bags 18. Within a bonding zone 42 the bag transport line defined by the belt conveyor 32 extends tangentially to the periphery of the handle assembling drum 40 in which area upper and lower assembling drums are forming a nip or bonding station through which the bags are passed and in which the handle blanks are pressed against the adhesive coated areas of the bags by their attachment portions.

The handle strip 44 supplied by the payoff unit 22 is intermittently fed in a position which is disposed downstream the handle assembling drum 40 as viewed in the bag flow direction, cut to predetermined length by cutters not shown and by means of a revolving finger 46 and guides 48 passed to the periphery of the handle assembling drum 40 where the handle strip is taken over by two grippers 50 of the handle assembling drum 40 which engage the strip in its center.

Two folding blades or skew folding devices 52 disposed outside the grippers 50 and closely adjacent thereto are used to fold the handle strip under an angle of 45° in each case. As the handle assembling drum 40 with handle strip continues to rotate, the two end portions of said handle strip are folded over 90° along predetermined fold lines by stationary guides 54 to thereby provide the U-shaped handle 16 which is being retained in its crossweb area by the grippers 50 while the parallel legs resulted from foldover of the handle strip end portions are trailing in the sense of rotation of the handle assembling drum 40. An adhesive applicator station 56 is provided to apply a hot adhesive dot to each of the free ends of the parallelly extending handle legs and/or mating faces of the attachment portions 24 and the handle 26. This is followed by bending said parallel legs of the handle by means of a rotating blade 58 and a folding tong 60 substantially in the center thereof so that the free end portions are coming off the peripheral face of the handle assembling drum 40. The bent free end portions of the handle form the attachment portions 24 while the U-shaped portion held by the grippers 50 form the handle 26. In other words, blade 58 folds the handles fed along a periphery of the handle assembling drum 40 at a juncture between attachment portions 24 and handle portion 26. In others words, blade 58 folds the handles fed along a periphery of the handle assembling drum 40 at a juncture between attachment portions 24 and handle portion 26.

A foldover bar or member 62 extending in the axial direction of the handle assembling drum 40 is moving on an arcuate path 64 substantially parallel to the periphery of the handle assembling drum 40 and in the same sense as said latter, but at a speed higher than the peripheral speed of that drum. The attachment portions 24 of the handle are seized by the foldover bar 62 and bent forwardly along given fold lines.

The turning center 66 of the arcuate path 64 is offset or eccentric relatively to the rotational axis of the handle assembling drum 40 and the radius of that path 64 is dimensioned such that the foldover bar 62 approaches the periphery of the handle attachment drum as it moves toward the bonding zone 42. This way, the attachment portions are bent forwardly by about 180° and entered into the nip or bonding station between drums 40 within the bonding zone 42. The foldover bar 62 travels back shortly before reaching the bonding zone 42 while the attachment portions are prevented from backfolding by the bag fed perfectly in time so that they are bonded to the bag inside the bonding zone 42 on one hand and by means of the adhesive dot provided inside the adhesive applicator station 56 are joined to the handle 26 on the other hand. This implies that the handle remains fixed to its attachment portions in foldover state and condition when the grippers 50 release the handle 26.

The reciprocating arcuate movement of the foldover bar 62 is in synchronism with the rotational movement of the blade 58. In the example as described such synchronism is established mechanically with the aid of a belt drive 68 and a disk cam 70 whose rotational movement is converted into the oscillating movement of a swivel arm 72 for the foldover bar 62 by a link guide assembly (not shown).

The counterpart disposed below the bag transport level of the arrangement hereinbefore described is identical with the only exception that in this case, too, the handle strip 44 is fed via the upper apex of the arcuate path of the finger 46 so that the distance it has to negotiate right up to the periphery of the handle assembling drum along the guide 48 provided there is shorter.

A number of equally spaced gripper pairs 50 may be disposed over the circumference of the handle assembling drum 40 so that a plurality of bags can be processed during any one drum revolution. The peripheral speed of the handle assembling drum 40 must correspond to the transport speed of the belt conveyor 32 to ensure that unobjectionable bonds are produced within bonding zone 42. In addition, the operating cycle of the handle assembling unit 12 must be in tune with that of the bag making machine 20. On the other hand, the pitch of the handle assembling drum 40 does not need to be equal to that of the bag machine's bottom folding drum 28, but may be smaller also. The pitch may be defined as the spacing between grippers 50 in the circumferential direction of drum 40.

In such latter case, the peripheral speed of the handle assembling drum 40 and hence also the speed of the belt conveyor 32 is lower than the peripheral speed of the bottom folding drum 28 so that the bags are somewhat delayed as they are taken over by the gripper drum 30.

The lower limit for the pitch of the handle assembling drum 40 is determined by the length of the bags to be processed, but since the portions 26 of the handles are folded over according to the present invention it is not necessary to make the length of said handles 26 part of the bag length. This permits to select a relatively small pitch for the handle assembling drum 40 so that the handle assembling unit 12 is suitable for use with a vast range of different bag making machines 10.

Figure 3:
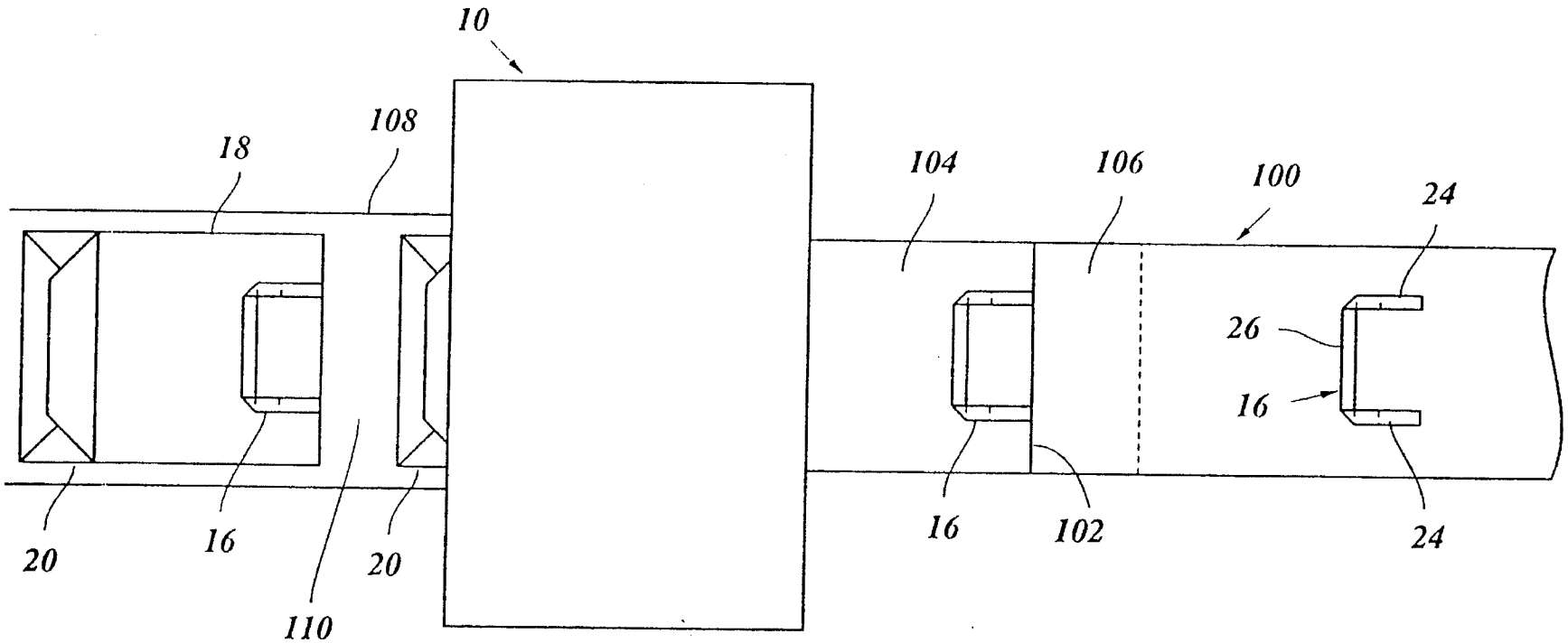
FIG. 3 is a schematic top view of a plant for production of bags with handles in a second embodiment of the method.
Figure 4:
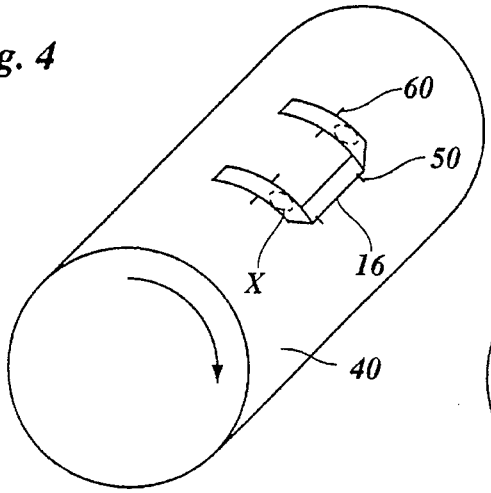
FIG. 4 is a perspective view of the handle assembling drum of FIG. 2, and also schematically showing the handle held by grippers, and the folding tong.
Figure 5:
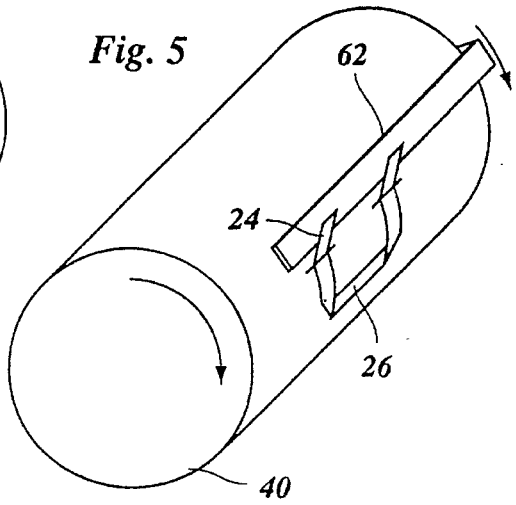
FIG. 5 is a perspective view of the handle assembling drum of FIG. 4, rotated further along, and showing the foldover bar.
Figure 6:
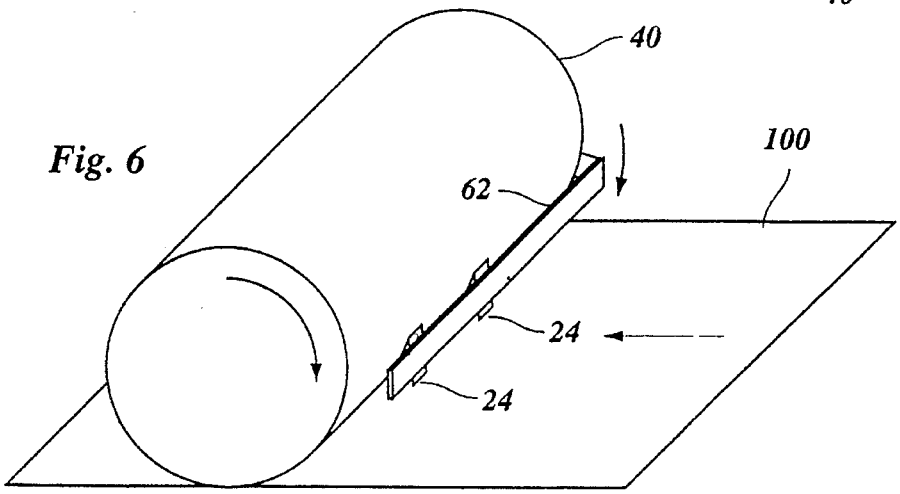
FIG. 6 is a perspective view of the handle assembling drum of FIG. 5, showing the foldover bar approaching the nip between the upper and lower drums.
Figure 7:
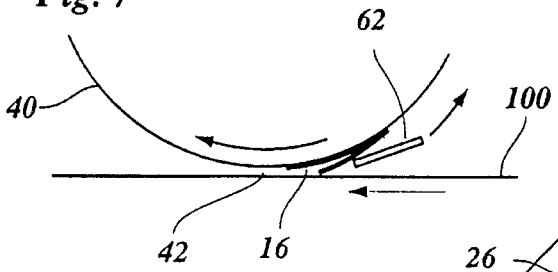
FIG. 7 is a schematic longitudinal section through the handle assembling drum and foldover bar which is closer to the nip.

FIG. 3 illustrates another embodiment of the method which differs from the one hereinbefore described by the fact that the handles 16 are attached to a tube web 100 already before sealing the bottom 20 and that subsequently the individual bags 18 are made from the tube stock.

The tubing 100 is continuously fed to the bag making machine 10. The handles 16 are attached in a station upstream the bag machine 10 for which purpose the handle assembling unit 12 described with reference to FIG. 2 (not shown in FIG. 3) can be used. The top view in FIG. 3 only shows the foldover portions 26 of the handles 16 while the attachment portions 24 are concealed by the parallel handle legs. The positions of the two free ends of handle 26 are disposed on a tube stock line which will be forming the upper marginal edge at the open end of the bag later on.

Figure 8:
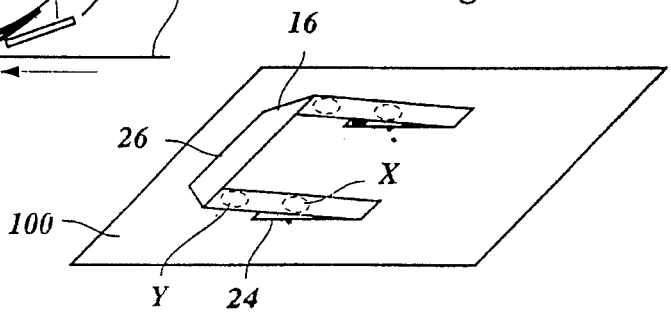
FIG. 8 is a perspective view of a handle secured to the tube.

After the handles 16 have been attached to the tubing the way as described above and the handle portions 26 have been tacked to the attachment portions 24 (xin FIG. 8) and/or the tubing 100 (yin FIG.8), the tube 100 will be divided into a plurality of individual blanks 104 by crosscuts 102 for one bag 18 to be made from each of said blanks in the bag making machine 10. The cut 102 extends immediately adjacent the free ends of the handle portion 26. Since the handle had been folded over in an earlier processing step, the handle 16 itself will not be affected by the cut 102.

Folding over the handle further results in that the tube portion 106 immediately adjacent the area of the cut 102 is not overlapped by the handle 16 so that the bottom of the next bag can be formed from said portion in the bag making machine. For this reason it is not necessary to increase the speed of the blanks 104 before entry into the bag machine 10 for the purpose of increasing the spacings between successive blanks.

The bags 18 leave the bag machine on a belt conveyor 108 after the bottom 20 has been formed inside the bag making machine 10.

Since formation of the bottom 20 involves material consumption, the length of the finished bags 18 is shorter than the length of the blanks 104 so that gaps 110 are formed between the individual bags in spite of the fact that transport speed has not been varied.

We claim:

1. A method for manufacturing bags with strap shaped handles, each of said handles comprising a handle portion protruding beyond the bag while the bag is in use and having two attachment portions of respective handle legs to be bonded to an outside face of the bag, comprising the following steps:

continuous feed of endless tube stock as starting material for bag production to a bag making machine;

folding handle legs over such that said handle legs are bent over forwardly in a tube stock transport direction, said handle legs being formed partially of said two attachment portions and partially of said handle portion;

assembling and bonding only said two handle attachment portions to an outside face of the tube stock during continuous transport;

detachable tacking of the folded over handle legs to at least one of:

the tube stock, and the attachment portions;

cutting the tube stock into sections for forming individual bags; and folding and sealing a bag bottom of each section inside the bag making machine.

2. A handle assembling device for attaching handles to tube stock of which bags are made, each of said handles comprising a handle portion protruding beyond the bag while the bag is in use and two attachment portions to be bonded to an outside face of the bag, the handles each including legs which are formed partially of said attachment portions and partially of said handle portion, comprising:

a handle assembling drum which is provided with handle grippers and which includes a bonding station for bonding the attachment portions to an outside face of the tube stock;

folding devices for folding the legs of the handles fed along a periphery of the handle assembling drum at a juncture between the attachment portions and the handle portion;

a foldover member which is movable substantially along the periphery of the handle assembling drum, whose speed is higher than the peripheral speed of the handle assembling drum and which operates in the same direction as said drum such that the attachment portions are seized on their way to the bonding station and folded over forwardly in a tube stock transport direction; and a tacking device to tack the handle to at least one of:

the attachment portions, and the tube stock.

3. Apparatus as defined in claim 2, wherein the tacking device includes an adhesive applicator station which is disposed at the periphery of the handle assembling drum and which serves to apply adhesive to at least one of:

the handle portion that is to contact the tube stock, overlying surfaces of the attachment portions and the handle portion.

4. Apparatus as defined in claim 2, wherein the foldover member is reciprocally movable on an arcuate path extending in eccentric relation to the rotational axis of the handle assembling drum.

5. Apparatus as defined in claim 4, wherein the folding devices comprise a blade which is adapted to revolve on an arcuate path and rotational movement of which is mechanically synchronized with reciprocating movement of the foldover member.

6. Apparatus as defined in claim 2, further comprising:

a payoff device for dispensing elongate handle strip, two skew folding devices for folding said handle strip and guides to fold over two end portions of the handle strip along predetermined fold lines so as to form the strip into a U-shaped handle, said payoff device, said two skew folding devices and said guides are all disposed at the periphery of the handle assembling drum, sequentially following each other in the order of said payoff device, said two skew folding devices and said guides, as viewed in the direction of rotation of the handle assembling drum.

* * * * *